United States Patent [19]

Farr et al.

[11] 4,445,402

[45] May 1, 1984

[54] POWER TONG AND BACK-UP TONG ASSEMBLY

[75] Inventors: Garth M. Farr, Kingwood; Patrick R. Callihan, Houston, both of Tex.

[73] Assignee: Farr Oil Tool, Inc., Houston, Tex.

[21] Appl. No.: 352,244

[22] Filed: Feb. 25, 1982 (Under 37 CFR 1.47)

[51] Int. Cl.[3] ..... B25B 17/00

[52] U.S. Cl. ..... 81/57.16; 173/164

[58] Field of Search ..... 81/57.16, 57.18, 57.2, 81/57.34; 173/164

[56] References Cited

U.S. PATENT DOCUMENTS

| | | | |
|---|---|---|---|
| 2,544,639 | 3/1951 | Calhoun | 255/35 |
| 2,650,070 | 8/1953 | Lundeen | 81/57.18 |
| 2,668,689 | 2/1954 | Cormany | 255/35 |
| 2,705,614 | 4/1955 | McKibben | 255/35 |
| 2,760,392 | 8/1956 | Paget | 81/53 |
| 3,025,733 | 3/1962 | Soodnizin | 81/53 |
| 4,082,017 | 4/1978 | Eckel | 81/57.16 |
| 4,084,453 | 4/1978 | Eckel | 81/57.18 |
| 4,246,809 | 1/1981 | Keast et al. | 81/57.16 |
| 4,333,365 | 6/1982 | Perry | 81/57.16 |

*Primary Examiner*—James L. Jones, Jr.

*Attorney, Agent, or Firm*—Arnold, White & Durkee

[57] ABSTRACT

A power tong and back-up tong assembly is comprised of a power tong having a rotatable cam surface which cooperates with jaw assemblies to grip and rotate a first pipe and a back-up tong having a fixed cam ring and jaw assemblies which are rotated against the cam ring in the same direction as the cam surface of the power tong rotates until an initial grip is achieved on a second pipe which is to be held while the first pipe is threaded or unthreaded relative thereto.

18 Claims, 5 Drawing Figures

POWER TONG AND BACK-UP TONG ASSEMBLY

BACKGROUND OF THE INVENTION

The present invention relates to power wrenches, and more specifically to a combination to power tongs for making up and breaking out threaded connections between adjoining tubular members. In particular, the invention relates to an assembly for gripping and rotating a first threaded tubular member into or out of a second tubular member which is secured against rotation.

Oil field tubular members, i.e. drill pipe and casing, are employed in sections which are joined together at their ends by threaded connections. Power tongs of the type herein described are utilized to make up and break out these threaded connections by securely gripping one tubular member and rotatably driving that member relative to the adjoining member.

In many situations, the adjoining member is not of a sufficient weight, nor attached to a sufficient number of other tubular members to preclude its rotation in response to the rotatably driven tubular member, thereby precluding a complete and tight threaded connection. Consequently, a back-up tong arrangement is utilized to grip the adjoining tubular member and prevent its rotation in response to the rotational torque being applied to the driven tubular member.

Heretofore, most back-up tongs have utilized a linkage assembly or mechanism to produce a clamping force upon the adjoining tubular member. The disclosures of the following representative U.S. patents depict such clamping arrangements: U.S. Pat. Nos. 2,544,639; 2,705,614; 2,760,392; and 4,082,017.

A draw-back of the back-up tong arrangements utilizing a linkage clamping action is that manual adjustments in the linkage positioning are frequently required to insure that a sufficient clamping force is achieved by the back-up tong. Several adjustments might have to be made in each make up or break out operation in order to achieve the proper clamping force on the adjoining tubular member before the tubular members are fully and tightly threaded together. The clamping linkage position had to be adjusted in each operation to avoid too high a setting which might result in a crushing of the pipe, and yet to arrive at a setting which would sufficiently grip the lower pipe. The prior back-up arrangements did not provide for an automatic increase of the clamping force as the torque through the driving tong increased. Therefore, a setting which adequately secured the adjoining tubular member initially, would frequently be ineffective if additional torque had to be applied to the driven tubular member to continue a threading or unthreading action.

Manual tongs are also used for back-up purposes. However, the bulkiness of these tongs, their weight, and the need to have their operators in the immediate vicinity of the clamping operation, which can be a dangerous environment, are all drawbacks to such devices.

Other power tong back-up assemblies are described in U.S. Pat. Nos. 2,668,689 and 3,025,733. These references also call for the transmission of varying levels of power or torque to the back-up tong in order that the back-up tong might sufficiently grip the adjoining tubular member throughout a threading or unthreading operation.

Consequently, there is believed to have been a need for a power tong and back-up tong assembly which is safe, relatively simple and reliable in construction, and yet effectively operable with a minimum amount of energy needing to be generated and transmitted to the back-up tong of the assembly in order to grip a tubular member during a threading or unthreading operation.

SUMMARY OF THE INVENTION

In accordance with the present invention there is provided a novel assembly for joining or disjoining threaded tubular members. The assembly includes a first tong adapted to receive and rotate a first tubular member in a first direction. This first tong includes a rotatable cam surface and a jaw assembly disposed between the cam surface and the first tubular member which is inserted into the first tong. The rotation of the cam surface acts to bring the jaw assembly into a gripping relationship with and thereby rotates the first tubular member.

The assembly also includes a second tong which is adapted to receive and hold a second tubular member in a fixed position relative to the first tubular member. The second tong includes a fixed cam ring having a cam surface. The fixed cam ring is axially aligned with the rotatable cam surface of the first tong. The second tong has a second jaw assembly, which is rotatable in the first direction. The second jaw assembly acts against the cam surface of the fixed cam ring so as to be urged into a gripping relationship with the second tubular member. Finally, the second tong includes a means for rotating the second jaw assembly until an initial gripping relationship is achieved with the second tubular member.

According to one aspect of the invention, the first tong includes a power driven rotatable rotary gear, which rotary gear has at least one pair of opposed cam surfaces on its interior surface. The jaw assemblies of the first tong have cam followers which are guided along the cam surfaces of the rotary gear as that rotary gear is rotated. The second tong is rotationally fixed relative to the first tong. Further, the fixed cam ring of the second tong also has at least one pair of opposed cam surfaces on its interior surface. A pair of rotatable, pivotally mounted jaw assemblies in the second tong also include cam followers which are guided along the cam surfaces of the fixed cam ring. These jaw assemblies are rotated in the same direction as the rotatable rotary gear of the first tong until an initial gripping relationship is achieved with the tubular member inserted into the second tong.

Accordingly, an outstanding feature of this invention is that a minimum amount of energy or power is needed to achieve an initial gripping relationship with the second tubular member and that further power is not required in the second tong to maintain that gripping relationship as the torque is increased through the first tong. Any urging of the second tong's jaw assemblies in the direction of the torque generated through the first tong will automatically increase the gripping force of those jaw assemblies on the second tubular member.

According to another aspect of the invention, the first and second tongs are secured to a single frame in order that they are rotationally fixed relative to one another. In the preferred embodiment, the rotational fixation is achieved by mounting the second tong on shafts extending from the frame to which the first tong is secured.

In the preferred embodiment, the jaw assemblies of the second tong are pivotally mounted between upper and lower rotatable plate members, which plate members are mounted above and below the fixed cam ring. Roller chains are mounted about the outer periphery of both the upper and lower plate members. A pair of drive sprockets are mounted in positions on a single drive shaft so as to engage the roller chains mounted about the upper and lower plate members. A hydraulically actuated motor operates to rotate the drive shaft and hence the drive sprockets to rotate the upper and lower plate members and the jaw assemblies.

According to another feature of the invention, the fixed cam ring is provided with gear arcuate grooves in its upper and lower surfaces. The upper and lower rotatable plate members also have plate arcuate grooves in their surfaces which face the fixed cam ring. The plate arcuate grooves correspond in size and shape and are aligned with the gear arcuate grooves when the plate members are mounted on the fixed cam ring in a neutral position. In this arrangement, the gear arcuate grooves and the plate arcuate grooves combine to form a channel, wherein a pin is mounted, thus limiting the rotational movement of the upper and lower plate members relative to the fixed cam ring.

According to another feature of this invention, a mechanism is provided for axially displacing the second tong and the first tong as a first tubular member and second tubular member are being threadably displaced relative to one another. Specifically, a hydraulically actuated piston is secured to the first tong and reciprocates within a cylinder mounted to the second tong.

Yet another feature of the invention involves the use of a control panel which is remote from the first and second tongs to hydraulically actuate all functions of the assembly of this invention.

According to still another feature of this invention, the fixed cam ring of the second tong includes arcuate channels on its upper and lower surfaces. These channels receive bearing load runners secured to the upper and lower rotatable plate members, thereby permitting proper rotational guidance of the plate members relative to the fixed cam ring as well as support of the upper and lower plate members by the fixed cam ring.

According to another feature of the invention, the cam surfaces of the pair of opposed cam surfaces on the interior of the rotatable rotary gear and the fixed cam ring are cooperatively shaped such that when the cam followers are cammed at points along the opposed cam surfaces, the jaw assemblies are positioned so that pipe sections gripped by the jaw assemblies in the first and second tongs are centered within the rotatable rotary gear and fixed cam ring respectively.

Accordingly, it is a general object of the present invention to provide a new and improved asembly for threadably joining or disjoining tubular members which is effective and which utilizes a minimum amount of energy to secure one of the tubular members in a fixed position.

The above and other objects and advantages of the present invention will become more apparent upon consideration of the drawings and the accompanying detailed description of a preferred embodiment.

DETAILED DESCRIPTION OF A PREFERRED EMBODIMENT

Figure 1:
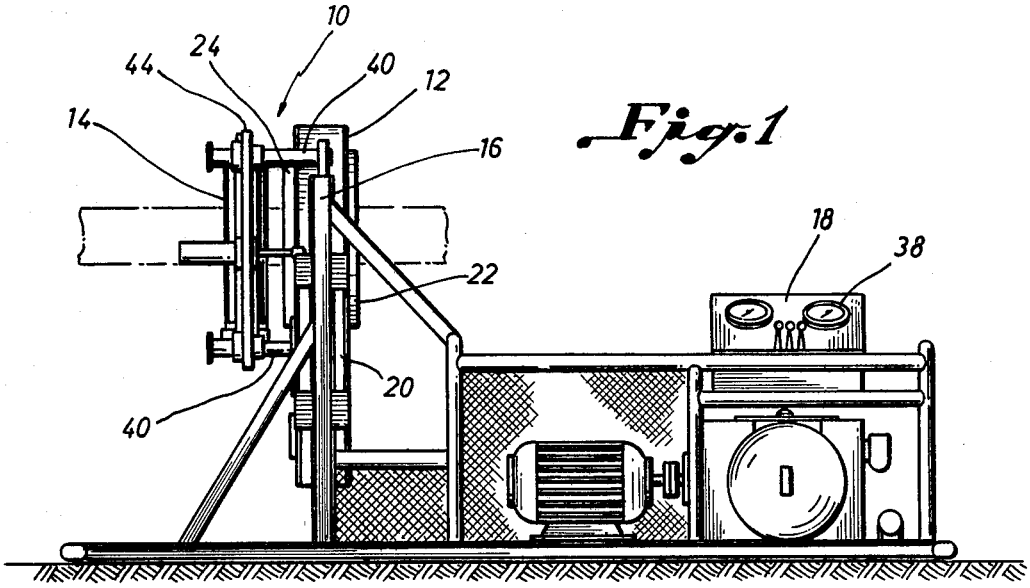
FIG. 1 is a side view of a pipe gripping assembly constructed in accordance with the present invention.

Referring now to the drawings, FIG. 1 shows a power tong and back-up tong assembly 10 which incorporates features of the present invention. The power tong and back-up tong assembly 10 is shown in an arrangement commonly identified as a bucking machine, which is utilized by pipe and collar threaders to couple and uncouple collars and pipes. The assembly 10 of this invention includes a power tong 12 for actually rotating a pipe or collar, and a back-up tong 14 for holding another pipe or collar in a fixed position while the first pipe or collar is threadably displaced relative thereto.

The assembly 10 depicted in FIG. 1 includes the power tong 12 and the back-up tong 14 fixed relative to one another and mounted on an assembly frame 16. Actuation of the power tong 12 and the back-up tong 14 is hydraulically controlled from a control panel 18 remote from the actual threading and unthreading operation and equipment.

The power tong 12 is the same as that described in U.S. Pat. Nos. 4,266,450 and 4,273,010, which patents are specifically incorporated by reference into this disclosure.

Specifically, the power tong 12 includes a frame 20, which is rigidly fixed to the assembly frame 16, and which supports an upper cage plate 22 and a lower cage plate 24 connected for rotation relative to the frame 20. The upper and lower cage plates carry and pivotally support gripping assemblies 26 which include jaws 27. The jaws 27 cooperate with a rotary gear 28 mounted within the frame of the power tong 12 and between the upper and lower cage plates 22, 24 so as to be movable between a rest position and a gripping position in connection with a pipe inserted into the power tong.

Figure 3A:
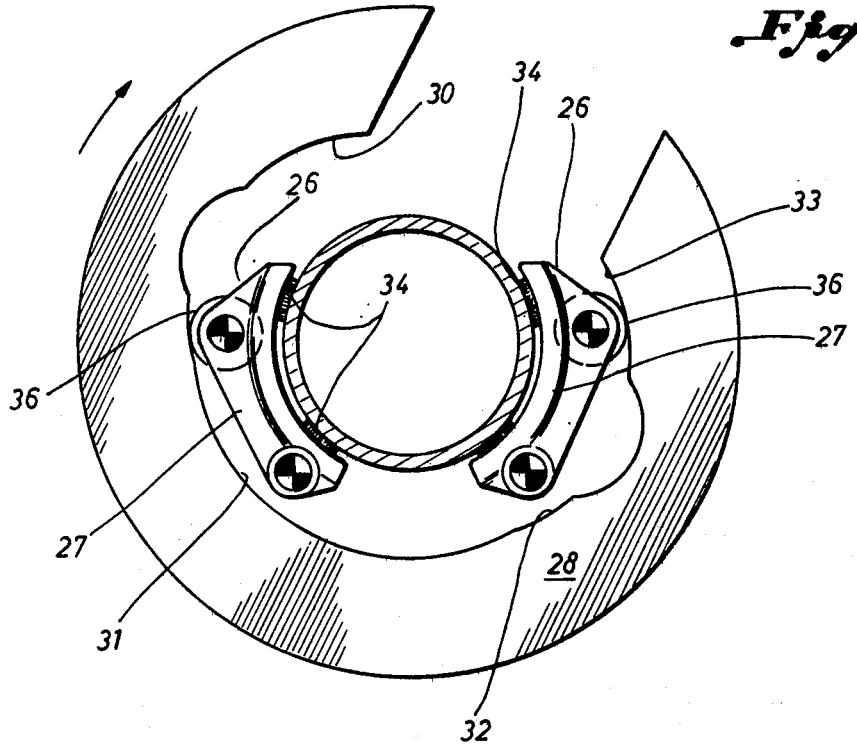
FIG. 3A is a top view of the rotary gear and gripping assembly for the power tong of the present invention.

The rotary gear 28 of the power tong 12 is mounted for rotation relative to the frame 20 and includes gear teeth on its outer periphery so that it may be rotatably driven in any manner well known in the art. In the present case pinion gears, suitably driven by a hydraulic drive train, operate the rotary gear. The inner surface of the rotary gear is substantially circular and includes cam means comprised of curved cam surfaces 30, 31, 32, 33, as best seen in FIG. 3A, which cam surfaces operate to urge the gripping assemblies 26 into contact with a pipe inserted into the power tong 12.

The gripping assemblies 26, as described in the incorporated references, include dies 34 arranged on the pair of pivotally mounted jaws 27. The jaws 27 include cam followers comprising jaw rollers 36 rotatably mounted on the jaws. As previously noted, the jaws 27 are pivotally mounted between the upper and lower cage plates 22, 24. The gripping assemblies 26 are arranged so that the jaw rollers 36 are adapted to ride on the cam surfaces on the interior of the rotary gear 28.

During a typical "make up" operation, the rotary gear 28 of the power tong 12 is driven in a clockwise direction so that the jaw rollers 36 ride along their respective cam surfaces 31, 33 until the dies 34 engage a pipe section inserted into the power tong. This is best seen in FIG. 3A. As gripping occurs, the upper and lower cage plates 22, 24 begin to rotate in conjunction with any further rotation of the rotary gear 28 since the gripping assemblies 26 are secured to the cage plates. This rotation is continued until a desired torque reading is achieved on an appropriate torque gauge 38 displayed on the control panel 18.

Figure 2:
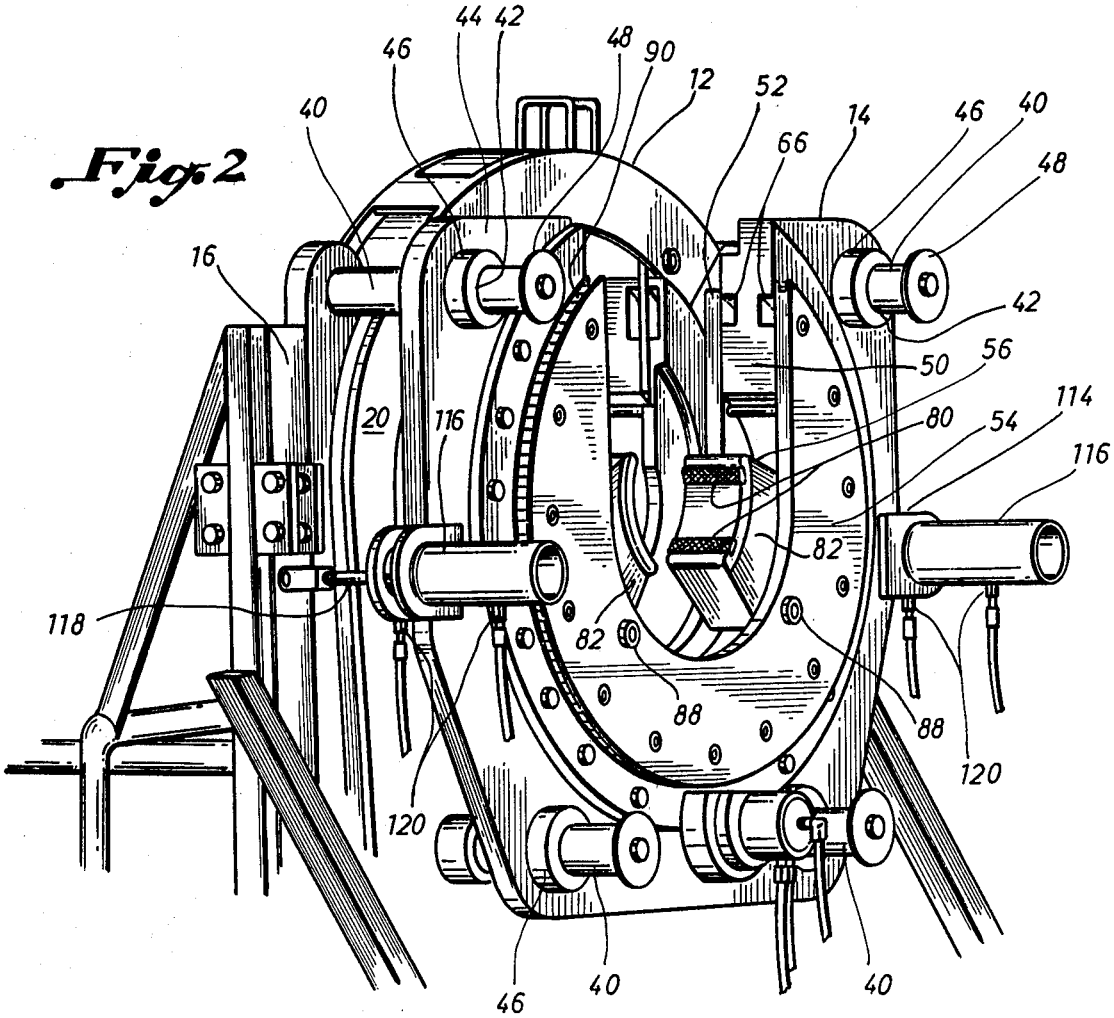
FIG. 2 is a perspective view of the back-up tong as it is mounted to the power tong and assembly frame.

Referring to FIGS. 1 and 2, the back-up tong 14 is mounted to the assembly frame 16, such as by shafts 40 extending from the assembly frame through channels 42 in the back-up tong frame 44. Specifically, the back-up tong frame 44 is provided with four openings or channels 42, bolstered by collars 46 or bosses on each side of the frame. These channels 42 receive the shafts 40 extending from the assembly frame 16, although they might also extend from the power tong frame 20 itself. This arrangement permits the back-up tong 14 to be axially translated along the shafts 40 relative to the power tong 12, thereby to accommodate movement of a pipe or collar as it is threaded on or off another tubular element. Movement of the back-up tong 14 off the shafts 40 is prevented by devices such as retainer caps 48 bolted to the end of the shafts.

The back-up tong 14 is mounted in axial alignment with the power tong 12, such that a tubular member secured in the back-up tong is aligned to threadably receive or discharge a tubular member secured within the power tong. Further, the back-up tong 14 is rotationally fixed relative to the power tong 12. In the preferred embodiment depicted in FIGS. 1 thru 4, the mounting of the back-up tong 14 on the four shafts 40 extending from the assembly frame 16 acts to rotationally fix the tongs relative to one another.

Figure 4:
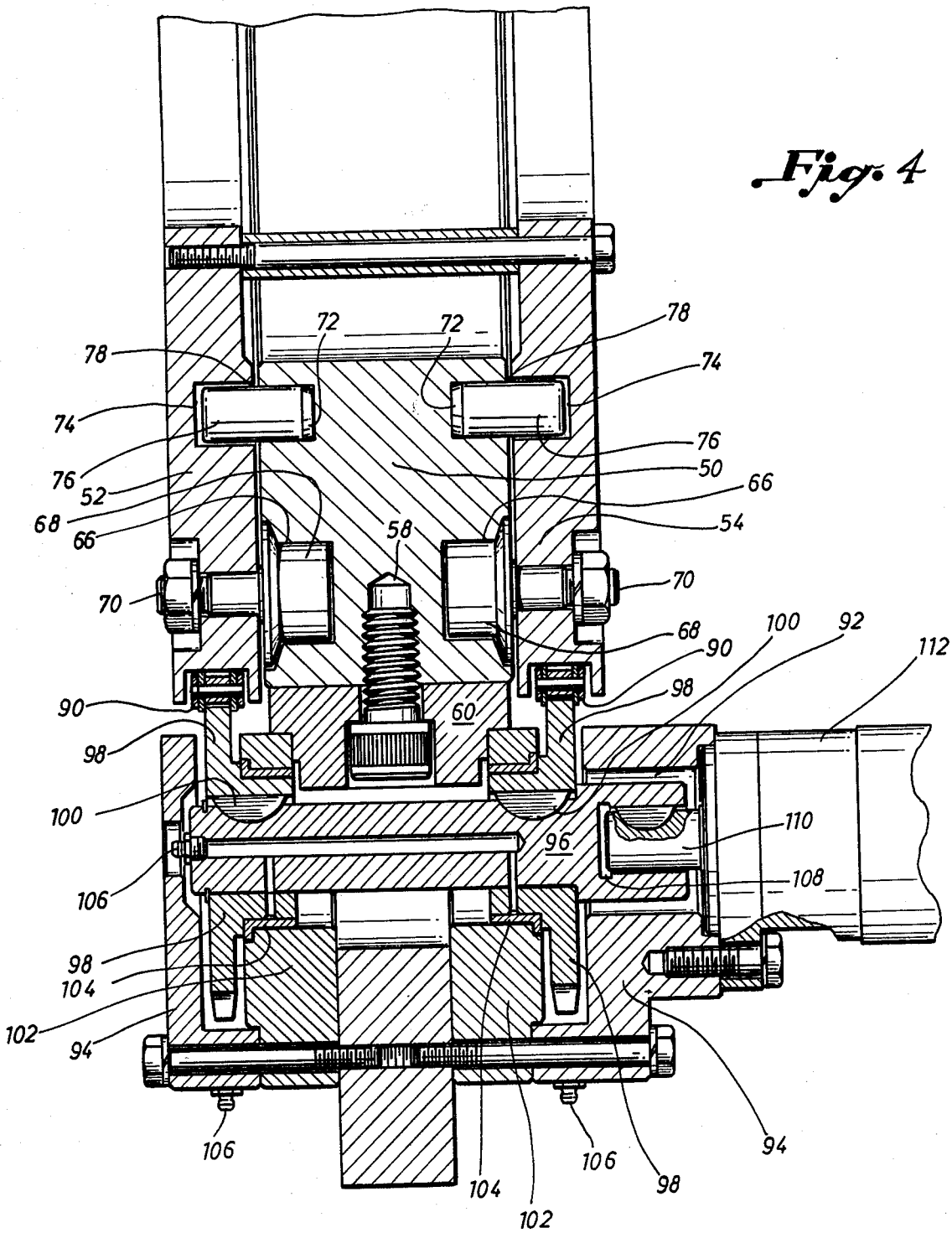
FIG. 4 is a vertical section view of the back-up tong taken substantially along line 4—4 of FIG. 2.

The back-up tong 14 of this invention utilizes a fixed cam ring 50 mounted between an upper cage plate 52 and a lower cage plate 54 similar to the arrangement for the power tong 12. However, in the back-up arrangement, the cam ring 50 is secured or mounted to the frame 44 of the back-up tong and the upper and lower cage plates 52, 54 alone are permitted to rotate, carrying a pair of back-up gripping assemblies 56. As best seen in FIGS. 2 and 4, the cam ring 50 is secured, as by bolts or screws 58 to a mounting flange 60 which is secured to the back-up frame 44, as by bolts or screws. Unlike the rotary gear 28 in the power tong, the cam ring 50 does not rotate.

The cam ring 50 is substantially similar in construction to the rotary gear 28 of the power tong 12. The inner surface of the cam ring 50 is substantially circular and includes a cam means comprising curved cam surfaces 62, 63, 64, 65 for urging the gripping assemblies 56 mounted to the rotatable cage plates 52, 54 into contact with a tubular member inserted into the back-up tong. In the preferred embodiment, the curved cam surfaces of both the power tong rotary gear 28 and the cam ring 50 are comprised of opposing cam surface pairs, i.e. pairs 30, 32 and 31, 31 for the rotary gear 28 and 62, 64 and 63, 65 for the cam ring 50. The following description of the cam surface pairs is applicable for the rotary gear 28 and the cam ring 50.

Figure 3B:
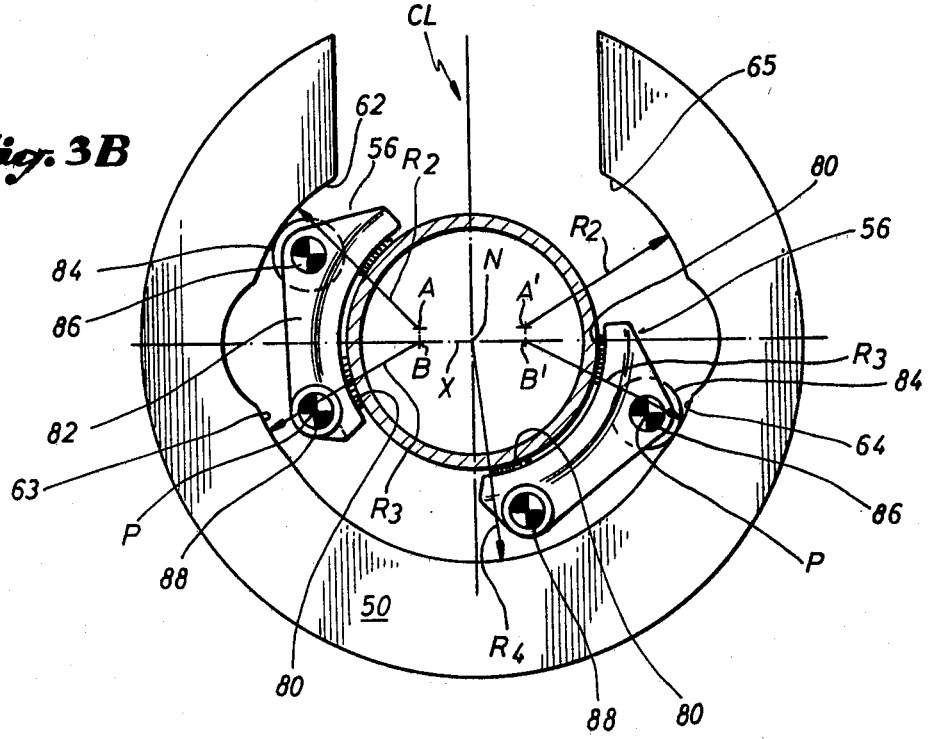
FIG. 3B is a top view of the fixed cam ring and gripping assembly of the back-up tong shown in its corresponding position relative to the rotary gear and gripping assembly of the power tong when in operation.

The opposing cam surface pairs, i.e. pairs 62, 64 and 63, 65 are not of equal curvature. As best shown in FIG. 3B, cam surfaces 62 and 65 define portions of circles having equal radii $R_2$ with their centers at points A, A′ offset from line X. Cam surfaces 63, 64 define portions of circles having equal radii $R_3$ with their curvatures at points B, B′ which are on line X. In the illustrated embodiment, the radii $R_2$ are slightly less than the radii $R_3$. In a particular embodiment of a rotary gear or cam ring for use on a $7\frac{5}{8}$ inch tong, the nominal radius $R_4$ of the rotary gear is $6\frac{3}{8}$ inches, $R_2$ is b 5.06 inches and $R_3$ is 5.26 inches with points A, A′ being offset from line X at a distance of approximately 0.40 inch.

The operation of the illustrated cam ring 50 and gripping assembly 56 can be best appreciated with reference to FIG. 3B. As the gripping assemblies 56 are rotated in a clockwise direction to the pipe-gripping position shown in FIG. 3B, jaw rollers 84 ride along their respective cam surfaces 62, 64 to urge the dies 80 into gripping contact with a pipe. Because cam surface 62 is moving, relatively speaking, toward the pivot point P of its respective jaw 82, the camming effect of this cam surface would be somewhat less than that of its opposed cam surface 64 if the two cam surfaces were identical. However, as illustrated in FIG. 3B, cam surface 62 has a greater curvature than cam surface 64 so that jaw rollers 84 ride along cams of equal effective pitch, thereby enabling each jaw 82 to approach the gripping position of FIG. 3B at the same rate.

When moving from the neutral position to the engaged position, both jaw rollers 84 move through an equal angle of rotation about pivot points P, thereby causing the center of rotation of the cam ring, M, to lie on the axis of the pipe, N.

It will be appreciated that the precise cam arrangements illustrated in FIGS. 3A and 3B are illustrative only. Other cam configurations may be devised. What is important is that the opposing cam surfaces be cooperatively shaped such that when the cam followers (jaw rollers) are at any two given points along the opposing cam surfaces, the opposed jaws will have moved to positions such that a pipe gripped therebetween will be centered within the rotary gear. In the usual case where there is symmetry about line CL, the jaws will have moved through the same rotational angle about their respective points at any time the jaw rollers are on the cam surfaces.

The cam ring 50 includes arcuate channels 66 on its upper and lower surfaces designed to receive bearing load runners 68 secured to the upper and lower cage plate members 52, 54, similar to those described in U.S. Pat. No. 4,266,450, which is incorporated by reference herein. The bearing load runners 68 may be secured to the upper and lower cage plates by bolts 70, and ride in the channels 66 upon rotation of the upper and lower cage plates 52, 54. This arrangements permits proper rotational guidance of the cage plates 52, 54 relative to the fixed cam ring 50.

The fixed cam ring 50 also includes two radial grooves 72 or recesses machined into its upper and lower surfaces. Similar radial grooves 74 are machined into the cam ring facing surfaces of the upper and lower cage plates 52, 54 and are aligned with the grooves 72 in the cam ring gear when the cage plates are mounted relative to the cam ring in a neutral or "rest" position. Pins 76 are placed in the channel 78 formed by the grooves in the cage plates and cam ring. The function of the pins 76 is to limit the distance which the cage plates 52, 54 can rotate relative to the cam ring 50, thereby to prevent an overcamming situation. This arrangement is described in more detail in U.S. Pat. No. 4,273,010, which has been incorporated by reference herein.

The gripping assemblies which are pivotally mounted to the upper and lower cage plates 52, 54 are similar to those arranged in the power tong 12. The gripping assemblies 56 comprise dies 80 mounted on a pair of jaws 82, which jaws are pivotally mounted to the upper and lower cage plates 52, 54. The arrangement of the gripping assembly elements can best be seen in FIGS. 2 and 3B.

Specifically, the jaws 82 are urged toward a pipe or tubular member inserted into the back-up tong 14 by means of cam followers comprising jaw rollers 84 rotatably mounted on the jaws, such as by pins 86. The jaws 82 are, in turn, pivotally mounted between the upper and lower cage plates 52, 54 by such means as pivot bolts 88. The jaw rollers 84 are adapted to ride on the cam surfaces 62, 63, 64, 65 on the interior of the cam ring 50 as the cage plates 52, 54 are rotated relative to the fixed cam ring Whereas the rotary gear 28 in the power tong 12 includes gear teeth on its outer periphery so that it may be suitably driven by pinion gears and a hydraulic drive train, the cam ring 50 in the back-up tong 14 needs no such gear teeth. Actuation of the back-up tong 14 is achieved by rotating the cage plates 52, 54 through a sprocket and roller chain drive system. It will be understood that other suitable drive means well known in the art may be utilized to rotate the cage plates in this invention.

In the preferred embodiment, roller chains 90 are secured to the outer periphery of the upper and lower cage plates 52, 54, as can be seen in FIG. 2. Referring to FIG. 4, there is mounted to the lower end of the frame 44 of the back-up tong 14 a sprocket drive mechanism 92 for rotating the cage plates. The housing 94 for the sprocket drive mechanism 92 is fixed on the frame 44 as by bolts or screws. A drive shaft 96 extends through the housing 94 and includes drive sprockets 98 positioned thereon in alignment with the roller chains of the upper and lower cage plates 52, 54. The drive sprockets 98 are fixed to the drive shaft 96, with relative rotation between the sprockets and the shaft being precluded as by the use of Woodruff keys 100. Bearing mounts 102 support the drive shaft 96 and drive sprockets 98, with sprocket bushings 104 being utilized between the bearing mounts 102 and drive sprocket 98. Grease fittings 106 are provided in the housing 94.

The drive shaft 96 includes a bore 108 at one end for receiving the rotatable shaft 110 of a hydraulically actuated motor 112 (hydraulic connections are not shown). Again, a Woodruff key arrangement may be utilized to mesh the driving shaft 110 and the sprocket drive shaft 96. A Nichols Model No. 100-7 hydraulically actuated motor may be used to drive the sprocket drive shaft. Pursuant to this arrangement, the upper and lower cage plates 52, 54 are simultaneously actuated and rotated by the single sprocket drive shaft 96, which is driven by the single motor 112.

In a typical make up operation, one end of a pipe would be inserted into the back-up tong 14 such that the exposed threads of that pipe would extend beyond the back-up tong 14 toward the power tong 12. The operator would hydraulically actuate the motor 112 from the control panel 18 to initiate rotation of the cage plates 52, 54 in a clockwise direction, and simultaneously the gripping assemblies 56. The jaw rollers 84 are thereby caused to engage the cam surfaces 62, 64 of the cam ring 50, and as . the gripping assemblies 56 rotate, they are urged toward the pipe. Once an initial grip or bite of the jaw dies 80 on the pipe is achieved, no further power to rotate the cage plates 52, 54 need be generated by the hydraulic motor 112.

The pipe or collar which is to be threaded onto the pipe being gripped by the back-up power tong 14 is arranged in the power tong 12. In a make up operation, the rotary gear 28 of the power tong 12 is actuated in a clockwise direction so that the jaw rollers 36 are urged along the respective cam surfaces 30, 32 until the jaw dies 34 are caused to engage the pipe or collar. As gripping occurs, the cage plates 22, 24 rotate in conjunction with further rotation of the rotary gear 28, and the pipe or collar is rotated and thereby threaded onto the previously gripped adjacent pipe section in the back-up tong 14.

The arrangement described above, wherein the back-up tong 14 is constructed to have its cage plates 52, 54 rotate relative to a fixed cam ring 50, and is operated to have its cage plates rotate in the same direction as the rotary gear 28 of the power tong 12, permits a pipe to be held in a fixed position by the back-up tong with a minimum amount of energy. No matter how much torque is required to be generated through the power tong 12 in a threading operation, no additional energy or torque needs to be transmitted to the back-up tong 14 to maintain the grip on the fixed pipe beyond that needed for the initial gripping. As additional torque is generated by the power tong 12 during threading, or unthreading, any urging of the "fixed" pipe to rotate in the back-up tong 14 will be in a direction which urges the gripping assemblies 56 engaged with the "fixed" pipe farther up the cam ring cam surfaces 62, 64, and hence into a tighter gripping relationship with the "fixed" pipe.

The correlation of fixed and rotating elements as called for by this power tong and back-up tong assembly 10, in combination with the correlated directional operation of the elements, results in the gripping action needed in the back-up tong 14 being automatically produced and responsive to the torque being generated by the power tong 12. The minimum energy necessary to produce an initial grip or bite on the "fixed" pipe is all that must be transmitted to the back-up tong.

As previously described, the back-up tong 14 is slidably mounted on four shafts 40 extending from the assembly frame 16, thus permitting the back-up tong 14 to translate toward or away from the power tong 12 as pipe sections are threaded or unthreaded relative to one another. Another outstanding feature of the present invention is a hydraulic pipe feed mechanism 114 which assists in the movement of the back-up tong during pipe threading or unthreading. Significant weight is frequently involved when large pipe sections are being joined or separated, and thus stress on the power tong 12 and back-up tong 14 is increased, as well as the required gripping forces necessary within the tongs, when heavy pipes have to be pulled or pushed relative to one another.

The hydraulic feed mechanism 114 consists of cylinders 116 mounted on each side of the frame 44 of the back-up tong as shown in FIG. 2. Pistons 118 having one end secured to the assembly frame 16 extend therefrom and have their other ends mounted in the cylinders 116. Hydraulic fluid inlets/outlets 120 are disposed at the approximate ends of the cylinders 116 and flank the permitted movement of the piston heads (not shown) within the cylinders.

The piston head is dynamically sealed within the cylinder 116 thus permitting the back-up tong 14 to be translated back and forth on the four shafts 40 as necessary during a threading or unthreading operation by alternating the introduction of hydraulic fluid into the cylinders 116 through the forward and rearward fluid inlets/outlets 120. This arrangement also permits the operator to reset the back-up tong 14 to an appropriate position once a threading or unthreading operation has been completed. This eliminates a step which would otherwise have to be performed manually, and which can involve the need for more than one person.

It will be noted that the embodiment described above utilizes the invention in what is called a bucking machine, the operation of which generally involves pipes or tubular members being joined while in a horizontal position. It will be appreciated that the above description of this embodiment was made accordingly and that the invention would function substantially as described when used in connection with the threading or unthreading of pipe vertically arranged, such as it would be during the running of pipe in the oil field.

While the present invention has been disclosed in connection with an illustrative embodiment, numerous modifications may be made without departing from the spirit or scope of the invention. For example, the cage plates of the back-up tong may be rotated by means other than the described roller chain and sprocket drive mechanism. Further, the back-up tong could be rotationally fixed relative to the power tong assembly without actually being mounted or affixed to the power tong. These, and other modifications of the invention, will be apparent to those skilled in this art and are intended to be within the spirit and scope of the present invention.

What is claimed is:

1. An assembly for threadably joining or disjoining tubular members comprising:

a first tong adapted to receive and rotate a first tubular member in a first direction, said first tong being of the type having a rotatable cam surface and a jaw assembly disposed between the cam surface and such a first tubular member in a manner that rotation of the cam surface acts to bring the jaw assembly into a gripping relationship with, and thereby rotate such a first tubular member;

a second tong adapted to receive and hold a second tubular member in a fixed position relative to a first tubular member, said second tong comprising:

a fixed cam ring having a cam surface, said cam ring being axially aligned with the rotatable cam surface of the first tong;

a second jaw assembly rotatable in said first direction which acts against the cam surface of the fixed cam ring so as to be urged into a gripping relationship with such a second tubular member; and means for rotating the second jaw assembly until an initial gripping relationship is achieved with such a second tubular member.

2. An assembly for displacing threaded tubular members relative to one another, comprising:

a first tong adapted to rotate a threaded first tubular member in a first direction, said first tong comprising:

a power driven rotatable rotary gear;

at least one pair of opposed cam surfaces on the interior of the rotary gear;

a pair of pivotally mounted jaw assemblies having cam followers which are guided along the cam surface of the rotary gear when the rotary gear is rotated, thus moving the jaw assemblies into a position to grip such a first tubular member inserted into said first tong; and means for rotating the rotary gear;

a second tong adapted to hold a threaded second tubular member while such a first tubular member may be threadably displaced relative to such a second tubular member, said second tong being rotationally fixed relative to said first tong, and said second tong comprising:

a fixed cam ring;

at least one pair of opposed cam surfaces on the interior of the fixed cam ring;

a pair of rotatable pivotally mounted jaw assemblies having cam followers which are guided along the cam surfaces of the fixed cam ring when the jaw assemblies are rotated in said first direction, said rotation of the jaw assemblies causing relative movement of the jaw assemblies into a position to grip such a second tubular member; and means for rotating the jaw assemblies in said first direction until an initial grip is achieved with such a second tubular member.

3. The assembly of claim 2, wherein the first and second tongs are secured to a single frame such that the first and second tongs are fixed against rotational movement relative to one another.

4. The assembly of claim 3, wherein the second tong is mounted on at least two shafts extending from the frame to which the first tong is secured.

5. The assembly of claim 2, wherein the means for rotating said jaw assemblies of said second tong comprises:

upper and lower rotatable plate members which are mounted above and below the fixed cam ring, said jaw assemblies being pivotally mounted between said upper and lower rotatable plate members;

a roller chain mounted about the outer periphery of both the upper and lower plate members;

a pair of drive sprockets having their teeth engaging the roller chains mounted about the upper and lower plate members respectively, said drive sprockets being mounted on a single drive shaft; and a hydraulically actuated motor operatively arranged to rotate the drive shaft on which said drive sprockets are mounted.

6. The assembly of claim 5, wherein the fixed cam ring includes gear arcuate grooves in its upper and lower surfaces, and wherein the upper and lower rotatable plate members include plate arcuate grooves in their surfaces which face the fixed cam ring, said plate arcuate grooves corresponding in size and shape and being aligned with the gear arcuate grooves in the upper and lower surfaces of the fixed cam ring when the plate members are in a neutral position, the aligned gear grooves and plate grooves thus forming a channel, and wherein a pin is mounted in said channel.

7. The assembly of claim 2, further comprising a means for axially displacing the second tong and the first tong as a first tubular member and a second tubular member are threadably displaced relative to one another.

8. The assembly of claim 7, wherein the means for axially displacing the second tong and the first tong comprises a hydraulically actuated piston which is secured to the first tong and reciprocates within a cylinder mounted to the second tong.

9. The assembly of claim 2, further comprising a control panel remote from the first and second tongs, through which panel the actuation of the functions of the assembly may be controlled.

10. The assembly of claim 2, wherein the cam surfaces of the pair of opposed cam surfaces in the interior of the rotatable rotary gear and fixed cam ring respectively are cooperatively shaped such that when the cam followers are cammed at points along the opposed cam surfaces, the jaw assemblies are positioned so that pipe sections gripped therebetween are centered within said rotatable rotary gear and fixed cam ring.

11. A pipe gripping assembly comprising:

an assembly frame;

a power tong, mounted to the assembly frame, comprising:

a tong frame having an opening for receiving pipe to be rotated;

a power driven rotary gear rotatably mounted on the tong frame;

at least one pair of opposed cam surfaces on the interior surface of the rotary gear;

a pair of pivotally mounted jaw assemblies having cam followers which are guided along the cam surfaces of the rotary gear when the rotary gear is rotated, thus moving the jaw assemblies into a position to grip pipe inserted into the power tong; and means for rotating the rotary gear;

a back-up tong, mounted to the assembly frame adjacent to the power tong and aligned with the power tong, said back-up tong comprising:

a base frame having an opening for receiving pipe to be held substantially stationary, which opening is axially aligned with the opening in the tong frame of the power tong;

a cam ring fixed to the base frame of the back-up tong;

at least one pair of opposed cam surfaces on the interior surface of the cam ring;

upper and lower plate members mounted above and below the cam ring for rotation in the same direction as the rotary gear of the power tong;

a pair of back-up jaw assemblies pivotally mounted to the upper and lower plate mebers, said back-up jaw assemblies having cam followers which are guided along the cam surfaces of the cam ring when the upper and lower plate members are rotated, thus moving the back-up jaw assemblies into a position to grip a pipe inserted into the back-up tong; and means for rotating the upper and lower plate members until an initial grip on a pipe inserted into the back-up tong can be achieved.

12. The pipe gripping assembly of claim 10, wherein the base frame of the back-up tong includes at least a pair of channel openings which receive shafts secured to the assembly frame, thereby to mount the back-up tong to the assembly frame in a manner which is rotationally fixed relative to the power tong but which permits axial translation of the back-up tong relative to the power tong.

13. The pipe gripping assembly of claim 10, wherein the means for rotating the upper and lower plate members comprises:

a roller chain mounted about the outer periphery of both the upper and lower plate members;

a pair of drive sprockets having their teeth engaging the roller chains mounted about the upper and lower plate members, said drive sprockets being mounted on a single drive shaft; and a hydraulically actuated motor operatively arranged to rotate the drive shaft on which said drive sprockets are mounted.

14. The pipe-gripping assembly of claim 12, further comprising a means for axially displacing the back-up tong and the power tong as a first pipe and a second pipe are threadably displaced relative to one another.

15. The pipe-gripping assembly of claim 14, wherein the means for axially displacing the back-up tong and the power tong comprises a hydraulically actuated piston which is secured to the power tong and reciprocates within a cylinder mounted to the back-up tong.

16. The pipe-gripping assembly of claim 11, further comprising a control panel remote from the power and back-up tongs, through which panel the actuation of the functions of the pipe-gripping assembly may be controlled.

17. The pipe-gripping assembly of claim 11, wherein the rotatable rotary gear and the fixed cam ring have at least one pair of opposed cam surfaces on the interior surfaces of said rotatable rotary gear and fixed cam ring, the cam surfaces of the pair being cooperatively shaped such that when the cam followers are cammed at points along the opposed cam surfaces, the jaws are positioned so that pipe sections gripped therebetween are centered within said rotatable rotary gear and fixed cam ring.

18. The pipe-gripping assembly of claim 11, wherein the cam ring includes gear arcuate grooves in its upper and lower surfaces, and wherein the upper and lower rotatable plate members include plate arcuate grooves in their surfaces which face the cam ring, said plate arcuate grooves corresponding in size and shape and being aligned with the gear arcuate grooves in the upper and lower surfaces of the cam ring when the plate members are in a neutral position, the aligned gear grooves and plate grooves thus forming a channel, and wherein a pin is mounted in said channel.

* * * * *

REEXAMINATION CERTIFICATE (472nd)

United States Patent [19]

Farr et al.

[11] B1 4,445,402

[45] Certificate Issued Feb. 25, 1986

[54] POWER TONG AND BACK-UP TONG ASSEMBLY

[75] Inventors: Garth M. Farr, Kingwood; Patrick R. Callihan, Houston, both of Tex.

[73] Assignee: Farr Oil Tool, Inc., Houston, Tex.

Reexamination Request:
No. 90/000,616, Aug. 31, 1984

Reexamination Certificate for:

| | |
|---|---|
| Patent No.: | **4,445,402** |
| Issued: | **May 1, 1984** |
| Appl. No.: | **352,244** |
| Filed: | **Feb. 25, 1982** |

[51] Int. Cl.[4] ..... B25B 17/00

[52] U.S. Cl. ..... 81/57.16; 173/164

[56] References Cited

U.S. PATENT DOCUMENTS

| | | | |
|---|---|---|---|
| 2,879,680 | 3/1959 | Beeman et al. | |
| 3,261,241 | 7/1966 | Catland . | |
| 3,507,174 | 4/1970 | Dickmann . | |
| 3,516,308 | 6/1970 | Ham et al. | |
| 3,550,485 | 12/1970 | Dickmann . | |
| 4,084,453 | 4/1978 | Eckel | 81/57.18 |
| 4,273,010 | 6/1981 | Farr et al. | 81/57.18 |
| 4,290,304 | 9/1981 | Eckel | 81/57.18 |
| 4,350,062 | 9/1982 | Farr et al. | |
| 4,402,239 | 9/1983 | Mooney . | |

FOREIGN PATENT DOCUMENTS

| | | |
|---|---|---|
| 1348954 | 3/1974 | United Kingdom . |

*Primary Examiner*—James L. Jones, Jr.

[57] ABSTRACT

A power tong and back-up tong assembly is comprised of a power tong having a rotatable cam surface which cooperates with jaw assemblies to grip and rotate a first pipe and a back-up tong having a fixed cam ring and jaw assemblies which are rotated against the cam ring in the same direction as the cam surface of the power tong rotates until an initial grip is achieved on a second pipe which is to be held while the first pipe is threaded or unthreaded relative thereto.

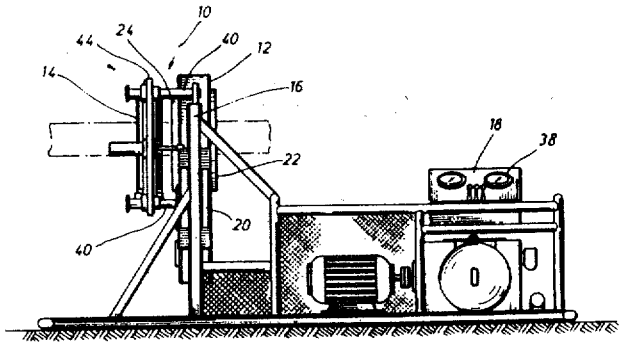

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 5, 6, 8, 13 and 15 is confirmed.

Claims 1–4, 7, 9–12, 14 and 16–18 are cancelled.

* * * * *